US011933566B2

(12) United States Patent
De Sousa

(10) Patent No.: US 11,933,566 B2
(45) Date of Patent: Mar. 19, 2024

(54) PORTED BAFFLE FIREARM SUPPRESSOR

(71) Applicant: Bernard De Sousa, Covington, GA (US)

(72) Inventor: Bernard De Sousa, Covington, GA (US)

( * ) Notice: Subject to any disclaimer, the term of this patent is extended or adjusted under 35 U.S.C. 154(b) by 263 days.

(21) Appl. No.: 15/886,994

(22) Filed: Feb. 2, 2018

(65) Prior Publication Data

US 2018/0202744 A1 Jul. 19, 2018

Related U.S. Application Data

(60) Provisional application No. 62/447,243, filed on Jan. 17, 2017.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
See application file for complete search history.

(56) References Cited

U.S. PATENT DOCUMENTS 1,207,264 A * 12/1916 Bailey ..... F41A 21/30 181/223
2,101,848 A * 12/1937 Green ..... F41A 21/34 181/223
2,449,571 A * 9/1948 Walker ..... F41A 21/30 89/14.4
4,907,488 A * 3/1990 Seberger ..... F41A 21/30 181/223
6,374,718 B1 * 4/2002 Rescigno ..... F41A 21/30 89/14.4
7,308,967 B1 * 12/2007 Hoel ..... F41A 21/30 181/223
7,594,464 B2 * 9/2009 Dueck ..... F41A 21/30 89/14.4
7,789,008 B2 * 9/2010 Petersen ..... F41A 21/30 89/14.4
8,100,224 B1 * 1/2012 Olson ..... F41A 21/30 181/212
8,701,543 B2 * 4/2014 Brinkmeyer ..... F41A 21/30 89/191.01
9,347,727 B1 * 5/2016 Cler ..... F41A 21/30
9,410,761 B2 * 8/2016 Morris ..... F41A 21/30
9,476,661 B2 * 10/2016 Troy ..... F41A 21/30
9,658,010 B1 * 5/2017 Oglesby ..... F41A 13/12
10,222,162 B2 * 3/2019 Adamson, Jr. ..... F41A 21/30
10,267,586 B1 * 4/2019 Marfione ..... F41A 21/30
10,619,962 B1 * 4/2020 Hatfield ..... F41A 21/44
2012/0272818 A1 * 11/2012 Dueck ..... F41A 21/30 89/14.4
2014/0299405 A1 * 10/2014 Miller ..... F41A 21/30 181/223

(Continued)

*Primary Examiner* — Edgardo San Martin
(74) *Attorney, Agent, or Firm* — BEKIARES ELIEZER LLP

(57) ABSTRACT

A firearm suppressor including an array of ported baffles and chambers in the suppressor assembly that may mitigate deleterious effects of gas pressure imbalances common in firearm suppressors. The suppressor may impart desirable noise suppression, gas balancing, and barrel heating characteristics to a firearm.

20 Claims, 9 Drawing Sheets

100

(56) References Cited

U.S. PATENT DOCUMENTS

| | | | | |
|---|---|---|---|---|
| 2015/0041246 | A1* | 2/2015 | Coley | F41A 21/30 181/264 |
| 2015/0090105 | A1* | 4/2015 | Pace | F41A 21/30 89/14.4 |
| 2021/0116199 | A1* | 4/2021 | Bryant | F41A 21/30 |

* cited by examiner

100

100

700

PORTED BAFFLE FIREARM SUPPRESSOR

RELATED APPLICATIONS

Under provisions of 35 U.S.C. § 119(e), the Applicant claims the benefit of U.S. provisional application No. 62/447,243, filed Jan. 31, 2017, which is incorporated herein by reference.

FIELD OF DISCLOSURE

The present disclosure relates to a device for a firearm suppressor. More specifically, various embodiments of the present disclosure relate to an report-suppressing ported baffle device that may be built into or fitted onto a firearm.

BACKGROUND

Firearm suppressors can be desirable for a number of reasons. Firing ammunition can produce sound pressure levels ("SPL") that are damaging to hearing, over both long and short term exposure intervals. Utilizing firearm suppressors can mitigate those effects by reducing the sound pressure levels associated with operating the firearm.

Quieter operation can also provide tactical advantages in military or law enforcement context. Reduced firing noise can aid in the stealthiness of an operation. Firearms having reports with lower SPL may also reduce confusion and loss of aural directional perception resulting from very loud weapon discharge in a firefight. If law enforcement is using effective suppressors, they may be better able to focus their attention on areas from which louder gunshots emanate.

Noise suppression may also be helpful in civilian contexts, such as firing ranges located near residential areas or close-quarters self-defense situations wherein very loud firing could be harmful to hearing.

Despite these advantages, there are problems with traditional approaches to firearm suppressor design. Common problems include poor balance, backpressure, and heating.

A typical suppressor, mounted to the muzzle of a firearm, can add weight to the front of a weapon and affect balance. Further, in many suppressor configurations the internal suppression structures can lead to bullet gases exerting backpressure toward the firing mechanism. This can lead to an array of firing problems. Suppressors can also experience heating, in some cases to temperatures well over the threshold to cause burns on contact. Firing and heating issues can be factors limiting the ability to effectively utilize suppressors on weapons with high rates of fire (such as fully-automatic firearms).

A solution that improves the equilibration of gases in the barrel, with favorable noise suppression, heating, and/or weight characteristics, may therefore provide advantages over the traditional approaches.

In view of at least the above shortcomings, a need exists for a ported baffle firearm suppressor.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

Examples described herein include suppressors that address back-pressure and heat issues. The suppressors may be supplied as stand-alone devices for retrofitting onto a rifle barrel. Alternatively, an upper receiver assembly of a rifle may include the suppressor. The upper receiver assembly may be attached to a body of a rifle in place of a stock upper receiver assembly that does not include a suppressor.

One objective of the disclosed suppressor may be to facilitate reductions in the SPL of a firearm's report. Such reduction may be on the order of tens of decibels.

Another objective of the disclosed suppressor may be to mitigate the negative firing characteristics attributable to bullet backpressure.

Further, another objective of the disclosed suppressor may be to allow for report suppression on rapid fire semi- and full-automatic firearms, while maintaining proper cycling.

Additionally, another objective of the disclosed suppressor may be to mitigate the barrel heating that accompanies suppressors.

In one example, a firearm barrel can incorporate a suppressor assembly that contains a series of pressure-equilibrating chambers, including an initial backpressure chamber, a flash chamber, and a vented baffle system that allows outflow of gases into vent chambers.

Upon firing a firearm equipped with one embodiment of the suppressor, the bullet can travel through the barrel bore, exiting the fore-barrel toward the distal end of the tube (i.e. toward the muzzle) that contains the suppressor assembly.

As the bullet proceeds forward through a succession of baffle bores towards the exit point of the firearm, gases produced by the firing mechanism that are trailing in the bullet's wake can exit the fore-barrel into the flash chamber and flow toward the proximal end of the tube (i.e. toward the breach), into a backpressure chamber. Gases may also flow toward the distal end of the tube, through ports in the baffle array into vent chambers, and through baffle bores leading to the exit point of the firearm.

In an embodiment, the high-velocity traversal of the suppressor assembly and exit point by a bullet can create a vacuum-like effect that draws gases towards the distal end (i.e., exit) of the tube.

In an embodiment, the system of vented baffles and chambers can assist in the equilibration of gas pressures, suppression of firing noise, and mitigation of overheating behaviors.

Embodiments of the present disclosure provide assemblies that may comprise, but are not limited to, ported baffles, connected chambers that allow gas flow, gas block and gas tube features, and various structures keeping components in place. Such an assembly may achieve various of the above-described objectives, or others.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the Applicants. The Applicants retain and reserve all rights in their trademarks and copyrights included herein, and grant permission to reproduce the material only in connection with reproduction of the granted patent and for no other purpose.

Furthermore, the drawings and their brief descriptions below may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
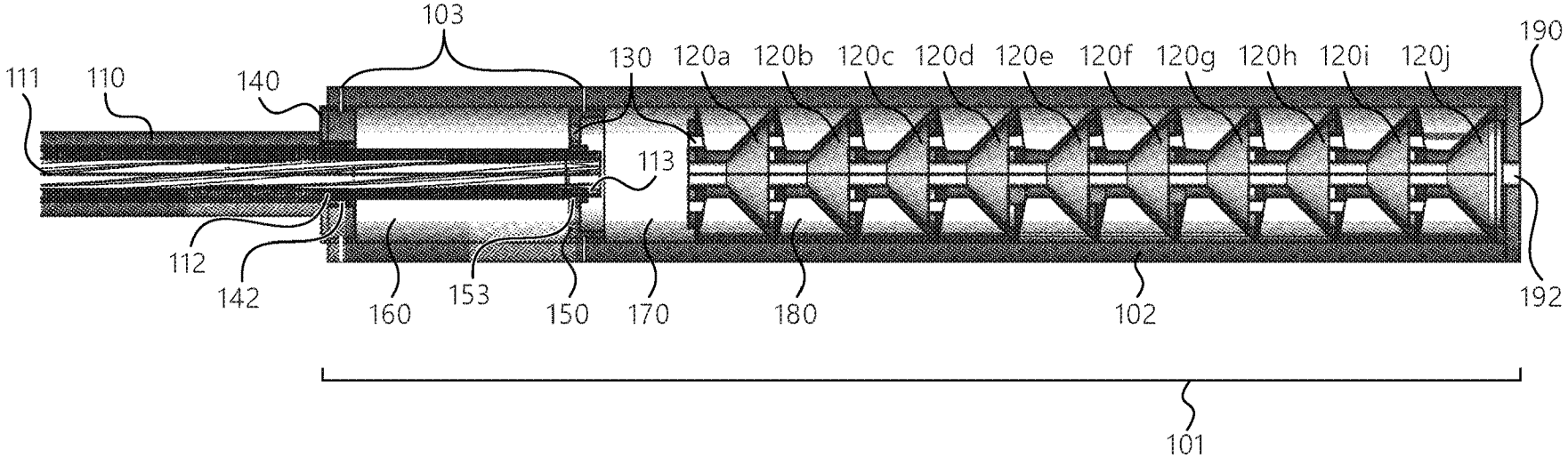
FIG. 1 illustrates a side sectional view of a ported baffle firearm suppressor in accordance with various embodiments of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of stages of various processes or methods that are described herein are illustrative and not restrictive. Accordingly, it should be understood that, although stages of various processes or methods may be shown and described as being in a sequence or temporal order, the stages of any such processes or methods are not limited to being carried out in any particular sequence or order, absent an indication otherwise. Indeed, the stages in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "stage for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of, embodiments of the present disclosure are not limited to use only in this context.

I. OVERVIEW

Consistent with embodiments of the present disclosure, a ported baffle firearm suppressor (or simply "suppressor") 100 for use with a firearm.

Figure 2A:
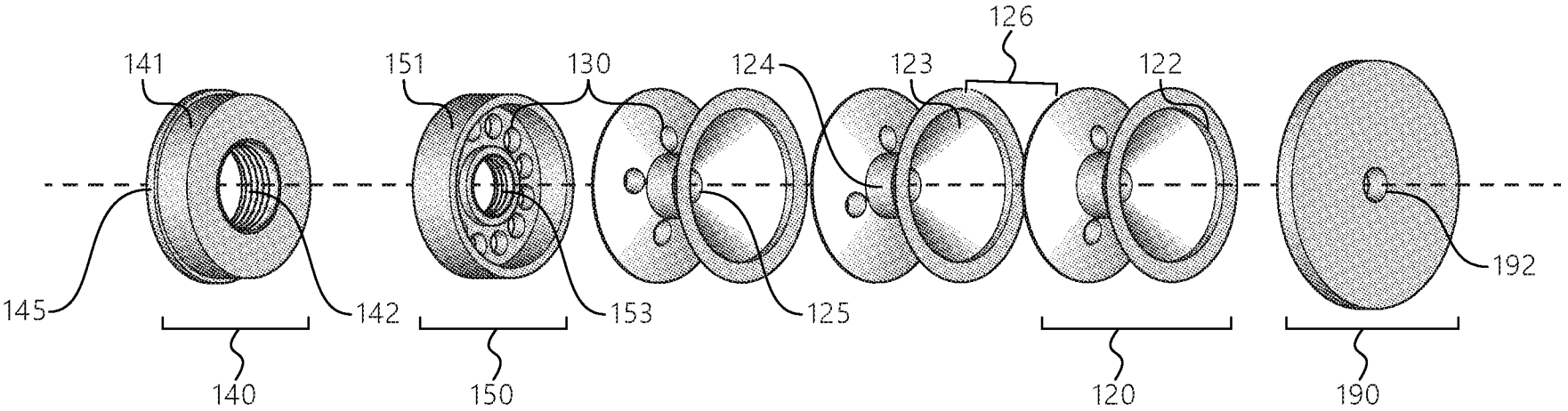
FIGS. 2A-B illustrate exploded views of a ported baffle firearm suppressor in accordance with various embodiments of the present disclosure.
Figure 2B:
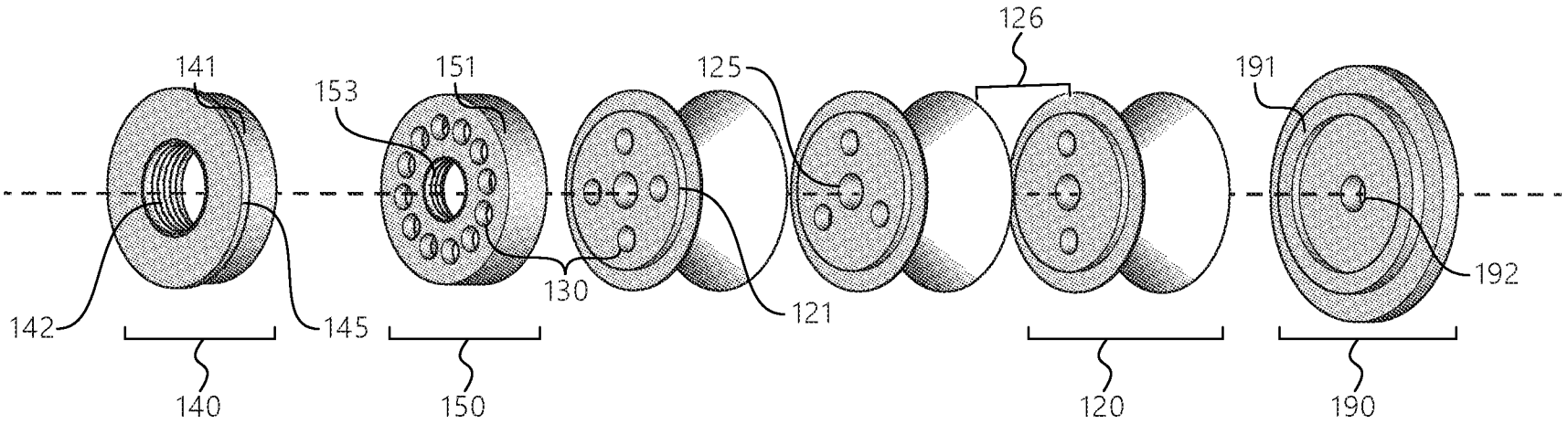
Figure 3:
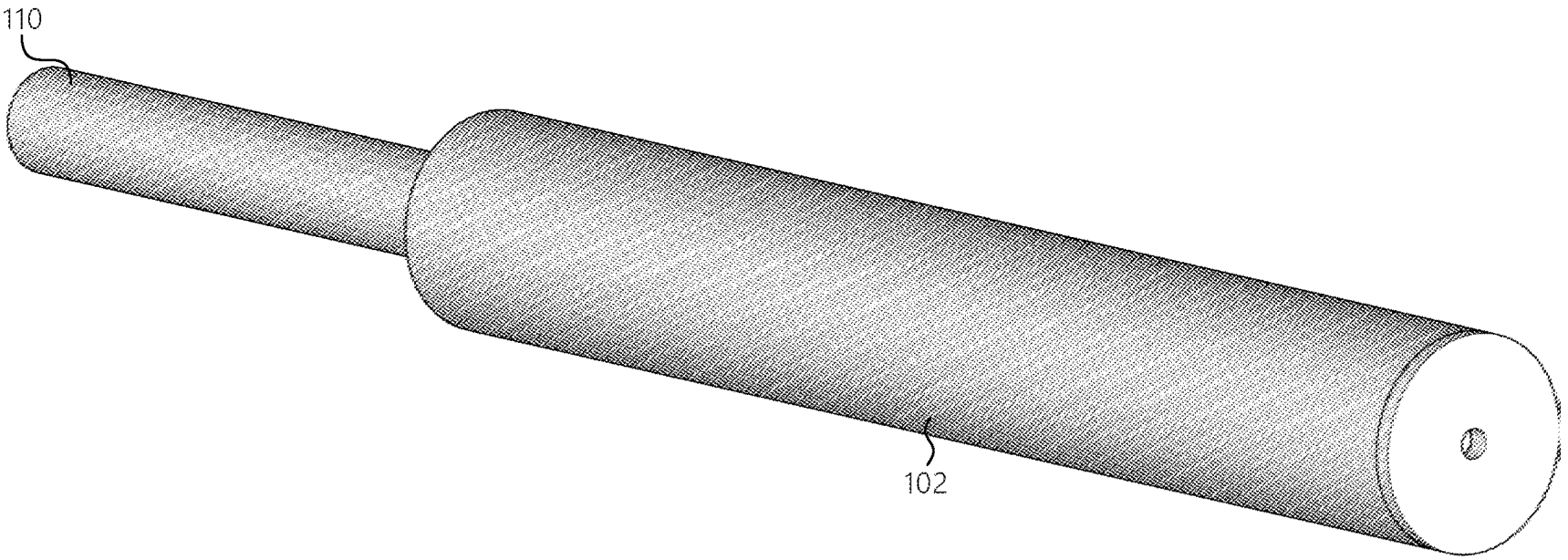
FIG. 3 illustrates a perspective view of a ported baffle firearm suppressor in accordance with various embodiments of the present disclosure.
Figure 4:
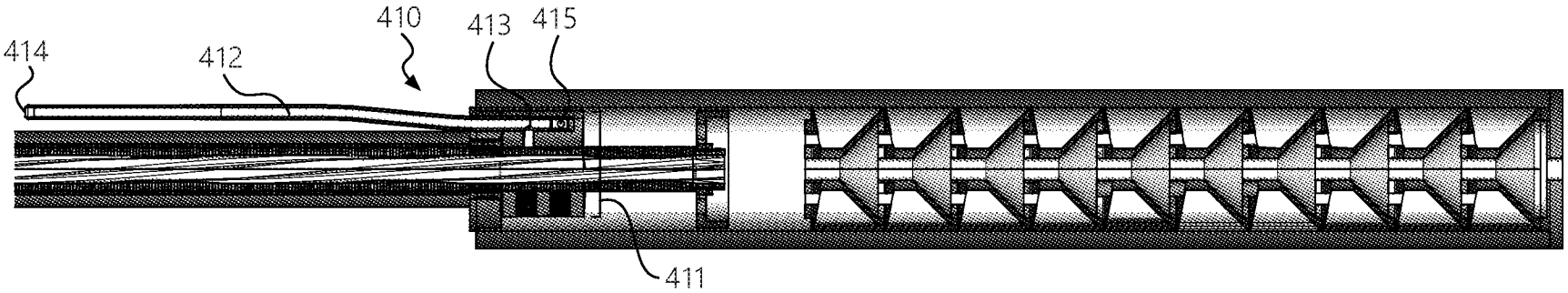
FIG. 4 illustrates a side sectional view of a ported baffle firearm suppressor with integrated gas block and gas tube in accordance with various embodiments of the present disclosure.
Figure 5A:
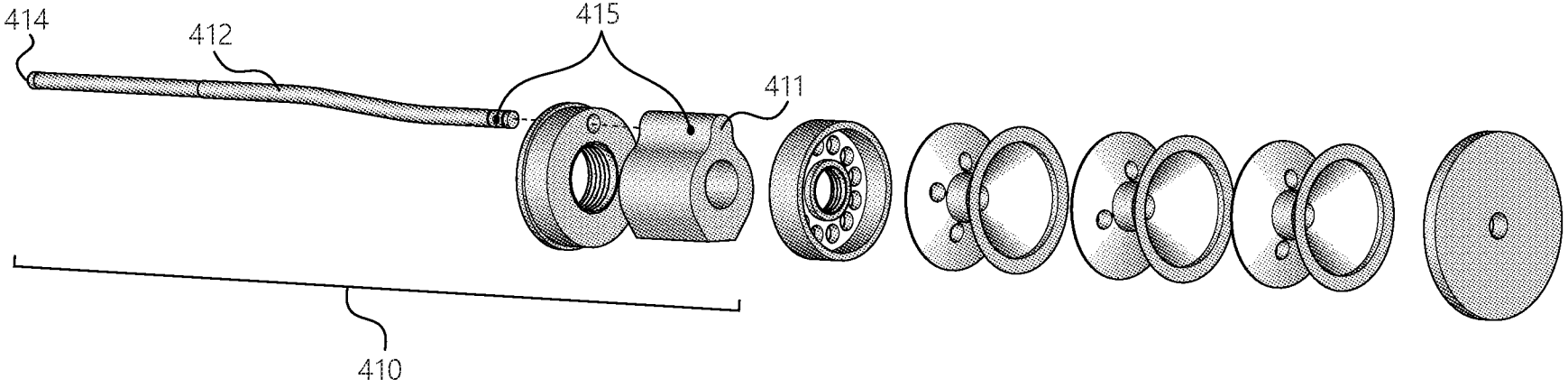
FIGS. 5A-B illustrate exploded views of a ported baffle firearm suppressor in accordance with various embodiments of the present disclosure.
Figure 5B:
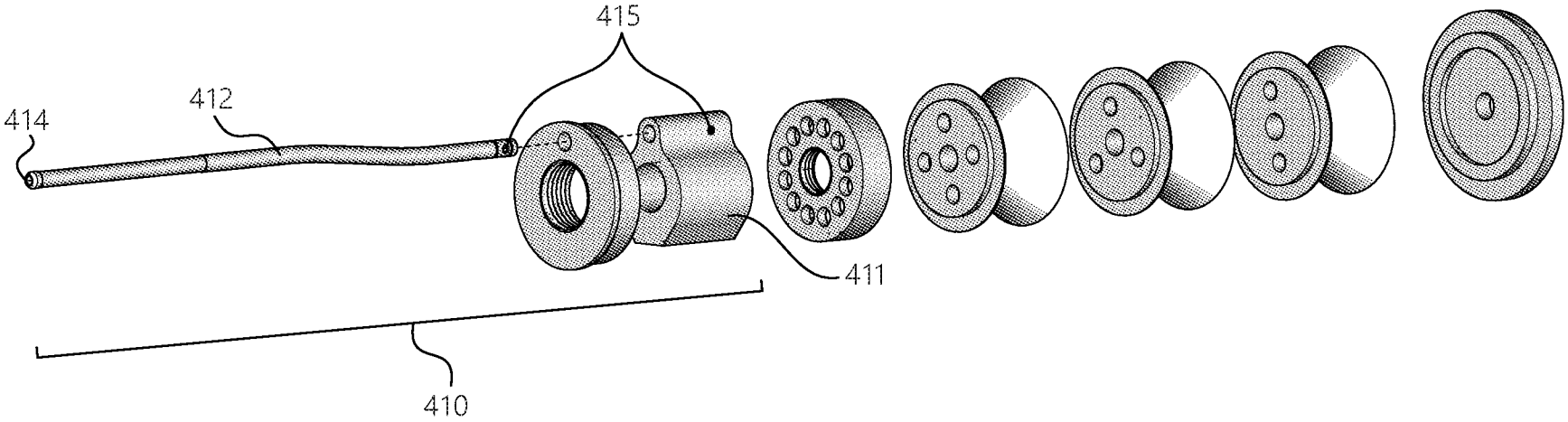
Figure 6:
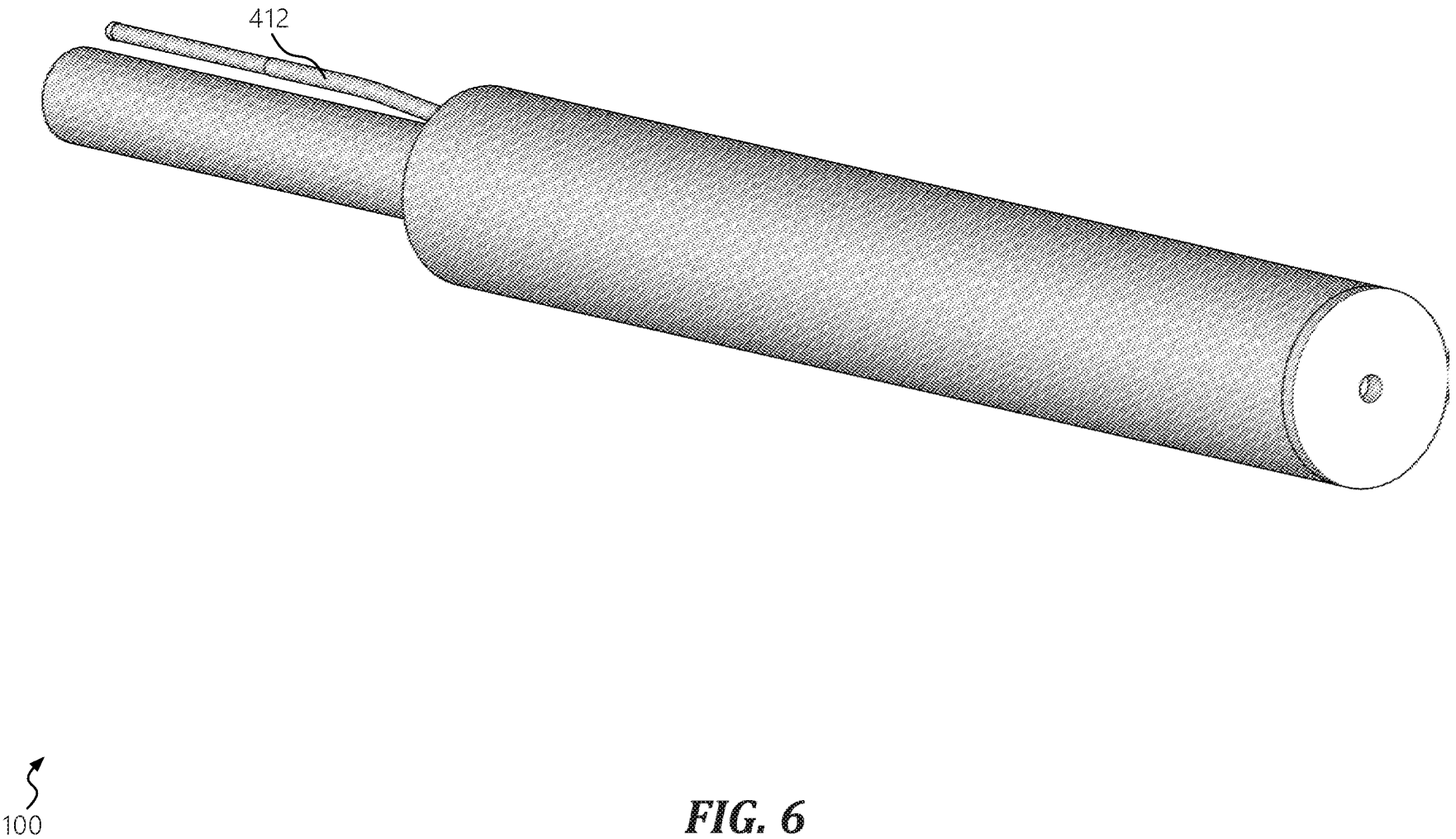
FIG. 6 illustrates a perspective view of a ported baffle firearm suppressor in accordance with various embodiments of the present disclosure.

Referring now to FIGS. 1, 2A-B, and 3 (collectively, FIGS. 1-3) there is shown an exemplary overview of structures and components that can be part of a suppressor 100 having ported baffles 120*a-j*. In FIGS. 1-3, the axial direction extends latitudinally from the fore-barrel 110 to the exit hole 192. In FIGS. 2A-B, the axial direction is represented by the dotted line. In FIGS. 2A-B, the radial direction extends in a plane perpendicular to the axial direction.

A suppressor 100 can integrate a suppressor assembly 101 with the fore-barrel 110 of a firearm. A suppressor assembly 101 can include a muzzle plate 190, one or more baffles 120 and resultant vent chambers 180, a front alignment sleeve ("FAS") 150, a rear alignment sleeve ("RAS") 140, a flash chamber 170, a backpressure chamber 160, and these components can be housed within a tube 102 and fixed in place to by one or more locking pins 103. The suppressor assembly 101 can be attached to the firearm by way of corresponding threading on the fore-barrel 110 and the front 150 and rear 140 alignment sleeves.

In various embodiments, suppressor assemblies 101 can include differing numbers of baffles 120. In an embodiment consistent with FIGS. 1-3, the suppressor assembly 101 can include ten baffles 120*a-j*. In other embodiments, there can be larger or smaller number of baffles 120. For ease of reference, without regard to the total number of baffles that can be present in an embodiment, the baffle 120 nearest the proximal end (i.e., bullet entry) of the tube 102 will be referred to as the "rearmost baffle" 120*a*, and the baffle 120 nearest the distal end (i.e., bullet exit) of the tube 102 as the "frontmost baffle" 120*j*.

As an integral or removable system, suppressor 100 may be employed in a variety of firearms, including rifles and pistols, semi- and full-automatic weapons, in various calibers and ammunition weights. In various embodiments, suppressor 100 may function optimally or solely with subsonic ammunition.

Referring now to FIGS. 4, 5A-B, and 6 (collectively, FIGS. 4-6) there is shown an exemplary overview of structures and components that can be part of a suppressor 100 that has an integrated gas management assembly ("GMA") 410. A gas management assembly 410, which may comprise a gas block 411 and gas tube 412, may assist with control of how bullet gasses flow. As such, a GMA 410 may improve the firing characteristics of a firearm equipped with a suppressor 100, in particular the specifically the cycling of semi- and full-automatic firearms so equipped. A GMA 410 may also mitigate some of the traditional impediments to effective use of suppression technology on such weapons.

II. COMPONENTS

Some or all of the following components may be present in a suppressor 100. The below description is in no way intended to limit the components that may be present in addition or in alternative to the listed components, nor to require that any particular component be included in a form described below or at all.

a. Fore-Barrel

A fore-barrel 110 can be the modified or unmodified barrel of existing or purpose-built firearm, including a rifle or a pistol. The distal end of the fore-barrel 110 can extend in the axial direction toward and into the proximal end of the tube 102. In an embodiment, the fore-barrel 110 can have front alignment threading 153 and rear alignment threading 142 that can accommodate the attachment of a front 150 and rear 140 alignment sleeves. In an embodiment, the front 153 and rear 142 alignment threading can be opposed.

A fore-barrel 110 can have a barrel bore 111 through which bullets can travel. The barrel bore 111 can have a diameter sized to accommodate various calibers and may be contoured (e.g. rifled) or smooth. The lengths of the fore-barrel 110, suppressor assembly 101, and suppressor 100 can vary in different embodiments, depending in some cases on the type of firearm (rifle, pistol, etc.). A firearm equipped with a suppressor 100 may have a rifle-, pistol-, or intermediate-length gas tube. A fore-barrel 110 can include a hinge mechanism.

b. Tube

A tube 102 can contain and form the outer boundary of the components of the suppressor assembly 101. In an embodiment, some or all of the various suppressor assembly 101 components (baffles 120, alignment sleeves 140, 150, etc.) can be modular, such that they can be manually assembled and disassembled (for e.g. cleaning purposes). In another embodiment, some or all of the various suppressor assembly 101 components can be integral to the tube 102 such that they cannot be manually assembled and disassembled. In yet another embodiment, the tube 102 and the rest of the suppressor assembly 101, along with the fore-barrel 110, can be manufactured such that the various components are inseparable, or separable in ways other that explicitly listed herein.

A tube 102 can be cylindrical, or its cross-section can have a shape other than circular, such as polygonal, ovoid, or irregular. A tube 102 may be tapered or otherwise non-uniform in dimension and shape along its length. A tube 102 may be constructed from various types of materials, including steel, aluminum, carbon fiber, or various alloy, composite, polymeric, or ceramic materials. A tube 102 may have holes in the radial direction to accommodate locking pins 103, other functional structures to accommodate firearm attachments or modifications, or other voids, protrusions, or structures that serve a similar purpose.

A tube 102 may be a simple unibody metal structure, or it may comprise a more complex interior structure. For example, a tube 102 may comprise interior features that deviate from the cylindrical shape depicted in FIGS. 1 and 4. Such interior features might seat, stabilize, combine with, or be integral with various baffle 120 features or other components (e.g. alignment sleeves 150, 160) in order to achieve structural goals such as a chambered (baffle 126, flash 170, vent 180, etc.) configuration.

c. Baffle

A suppressor 100 may include one or more baffles 120. A baffle 120 may comprise a number of features, including an entry face 121 (also called "posterior face" or "proximal face"), anterior lip 122 (also called "coupling surface"), conical cavity 123, baffle neck 124 and baffle bore 125. In a suppressor 100, the one or more baffles 120 can couple together in the axial direction. The coupling together of baffles 120 may enclose space into baffle chambers 126 and delimit external space into vent chambers 180.

A baffle's entry face 121 can form the proximal end of a baffle 120. The entry face 121 can include one or more ports 130 through its body. For example, the entry face 121 can include a number of cylindrical voids in the axial direction that open at both the proximal and distal sides of the entry face 121. An entry face 121 can also include an opening for the baffle bore 125.

In some embodiments, the entry faces 121 of successive baffles 120 from rearmost 120*a* to frontmost 120*j* can contain a decreasing number of ports 130. In one such embodiment, the rearmost baffle 120*a* can have four ports 130, along with zero or more succeeding baffles 120, followed by a baffle 120 with three ports 130, along with zero or more succeeding baffles 120, followed by a baffle 120 with two ports 130, along with zero or more ports up to the foremost baffle 120*j*. In an example consistent with that embodiment, baffles 120*a-d* can have for ports 130, baffles 120*e-g* can have three ports 130, and baffles 120*h-j* can have two ports 130.

In an embodiment, the entry face 121 can have a lip, ridge, protrusion, or mechanism that couples in the axial direction with the anterior lip 122 of another baffle 120. The anterior lip 122 can form the distal end of a baffle 120, and can likewise be shaped so as to mechanically couple with the entry face 121 of another baffle 120.

The result of coupling two baffles 120 together (or a baffle 120 with the muzzle plate 190) may be the demarcation of two spaces: the interior space as a baffle chamber 126 and the exterior space as a vent chamber 180. In an embodiment, the resultant gases from firing ammunition can flow through ports 130 in the entry faces 121 of baffles 120, and thus between baffle chambers 126 and vent chambers 180 situated along the axial direction of the tube 102 as the gases ultimately make their way toward the exit hole 192. This can play a role in pressure balancing the gases in the suppressor assembly 101 and facilitate desirable noise suppression characteristics.

A conical cavity 123 (also called a "distal cavity") may, but need not necessarily, be a void having the geometry of a conical frustum, with the wider "base" of this void opening to the distal (i.e. exit) side of the baffle 120, and narrowing to an opening to the barrel bore 125. In various embodiments, the conical cavity 123 can have square, hexagonal, spiral, irregular, etc. structure. In an embodiment, a conical cavity 123 may terminate in a distinct anterior lip 122. In some embodiments, a conical cavity 123 may itself be (or be described as) the coupling member at the most distal end of the baffle 120, which can couple with entry face 121 of another baffle 120.

The exterior surface of the conical cavity 123 can be connected at its proximal end to the distal side of the entry face 121 by a baffle neck 124.

The baffle bore 125 can be a void that connects an opening in the entry face 121 of a baffle 120 to an opening in the conical cavity 123, such that a bullet travelling through one baffle 120 or multiple coupled baffles 120 would have an unobstructed path from the barrel bore 111 through the one or more baffle bores 125 and out the exit hole 192. A baffle bores 125 can be have a diameter sized to accommodate various calibers. In one embodiment, the baffle bore 125 can be cylindrical and smooth. In other embodiments, the baffle bore 125 may have alternative geometries that nonetheless present an unobstructed path for bullets.

A baffle 120 can be constructed from various types of materials, including steel, aluminum, other alloys, ceramics, and composites. A baffle 120 can have a homogenous material composition (e.g. machined entirely from aluminum), or a heterogeneous material composition (as where different features of a baffle 120 comprise different materials). An array of baffles 120 need not be uniformly composed; two baffles 120 in an array may comprise different alloys or materials, different structural features (e.g. wall angles of the respective conical cavities 123), different numbers and shapes of ports 130, etc. In an example, a set of baffles (e.g. 120*a-d*) most distant from the distal end of the tube 102 may be constructed from stainless steel, while a set of baffles (e.g. 120*e-j*) nearest the distal end of the tube 102 may be constructed from aluminum.

A baffle 120 may comprise more or fewer components than described above; for example, the proximal end of the conical cavity 123 may directly adjoin the distal end of the entry face 121, such that the baffle 120 does not have a baffle neck 124. Also, in various embodiments, the orientation of baffles 120 and the components thereof (proximal vs. distal sides, etc.) may be reversed or altered from the above described orientation.

An array of baffles 120 may comprise or consist entirely of baffles 120 that are permanently joined rather than detachably coupled. For example, such an array of ported baffles 120 may produced as a single piece in an additive manufacturing process, or joinable halves in a casting process. Baffles 120 may also be permanently joined with other components such as the tube 102 or the muzzle plate 190. In an embodiment, there may not be a clear distinction between discrete tube 102, baffle 120, and other components where a suppressor 100 (or a sub-assembly) is produced as an indivisible unit.

Baffles 120 need not be directly coupled with each other to form chambers such as baffle chambers 126 and vent chambers 180. In an embodiment, the coupling (or fixed proximity, as with baffles 120 that are individually internally stabilized by struts or locking structures) between one or more baffles 120 and the tube 102 may be sufficient to seal against, or regulate, gas flow without any of the individual baffles 120 being in physical contact with another baffle 120.

d. Muzzle Plate

A muzzle plate 190, containing an exit hole 192 for egress of fired ammunition, can enclose the suppressor assembly 101 and form its distal face. The proximal side of the muzzle plate 190 can attach to the distal end of the tube 102. In an embodiment, this coupling can be achieved by a welding process (if, for example, the muzzle plate 190 and tube 102 are constructed from weld-tolerant materials). In another embodiment, this coupling can be achieved by an epoxying process. A muzzle plate 190 may be constructed from various types of materials.

The proximal face of a muzzle plate 190 can include a posterior lip 191 that accommodates the coupling of the muzzle plate 190 to the anterior lip 122 of the foremost baffle 120*j*.

e. Front and Rear Alignment Sleeve

A front alignment sleeve 150 can include a front alignment sleeve side wall 151, front alignment sleeve threading 153, and one or more ports 130. A rear alignment sleeve 140 can include a rear alignment sleeve side wall 141, rear alignment sleeve threading 142, and a terminal lip 145.

In an embodiment, the front alignment sleeve 150 can be a disk-like body with ports 130 opening the proximal and distal faces of the FAS 150 in the axial direction. In another embodiment, the FAS side wall 151 may incorporate ports 130, in alternative or in addition to ports through the body of the FAS 150.

In an embodiment, the RAS 140 can form the proximal (i.e., entry) face of the suppressor assembly 101, through the center of which protrudes the distal (i.e., exit) end of the fore-barrel 110. The RAS 140 may couple with the tube 102 by way of a terminal lip 145. In an embodiment, the terminal lip 145 can extend in the radial direction slightly further than the RAS side wall 141, such that the tube 102 can slide snugly along the axial direction over the RAS side wall 141 but proceed no further upon contacting the protruding terminal lip 145 at the most proximal point of the finished suppressor assembly 101.

The FAS 153 and RAS 142 threading can be used to secure, respectively, the FAS 150 and RAS 140 to the fore-barrel 110 by way of front 113 and rear 112 alignment threading thereupon. The FAS 153 and RAS 142 threading can form the innermost radial surfaces of the respective FAS 150 and RAS 140.

In an embodiment, the FAS 153 and RAS 142 threading can comprise screw-type threading having a square, trapezoidal, v-, etc. thread form. In such an embodiment, the FAS threading 151 and RAS threading 141 may be opposed. In other embodiments, the coupling between rear alignment threading 112 and RAS threading 142, or front alignment threading 113 and FAS threading 153, can be of a configuration other than screw-type threads—for example, a set of interlocking protrusions or another coupling mechanism.

In an embodiment, the front 151 and rear 141 sidewalls can conform to the inner surface of the tube 102. This may create a sealing effect that isolates the flash chamber 170 from the backpressure chamber 160 except for ports 130 through the body of the FAS 150.

In an embodiment, the front 151 and rear 141 sidewalls can serve as the anchoring surfaces (as by, e.g., having appropriate threaded holes) for the locking pins 130 that can be used to secure the suppressor assembly 101.

In an embodiment, the FAS 150 and RAS 140 can each serve as one stabilizing member in a multipoint stabilization configuration. In an embodiment, the RAS 140 can act as one stabilizing member, at the proximal end of tube 102, while the FAS 150 can act as another stabilizing member, slightly nearer the distal end of the tube 102 at the distal end of the fore-barrel 110.

In an embodiment, FAS 150 can couple directly with the rearmost baffle 120*a* (e.g. by interposing a cylindrical member between them), this coupled arrangement forming the radial extent of the flash chamber 170 rather than the inner surface of the tube 102.

In some embodiments, there can be more than two alignment sleeves. In other embodiments, the multipoint stabilization and chamber delineation that can be provided by front 150 and rear 140 alignment sleeves can be achieved using a monolithic alignment sleeve. Alignment sleeves 150 and 160 may employ a fastening mechanism other than opposed threads, such as locking channels, pins, etc. In addition or alternative to one or more alignment sleeves 150, 160, there may be stabilizing structures such as struts, columns, lattices, welds, joints, or other means of mechanical coupling.

f. Ports

Ports 130 may be circular, slotted, spiral or any other shape or configuration that accommodates the movement of gas between various ported chambers. Any reference herein to increasing or decreasing a number of ports 130 can include, additionally or alternatively, changing the area or geometry of ports 130. A port 130 may be a simple through-hole or it may have more complex geometry. For example, a port 130 may have features (e.g. threading, grooving, or channeling) on its interior wall. For another example, a port 130 may comprise an interconnection (e.g. a connecting tube) to a chamber other than its immediate neighbor. For yet another example, a port 130 may comprise a structure protruding into a chamber (e.g. an open tube or funnel).

g. Locking Pins

Locking pins 130 may be used to secure the suppressor assembly 101 to the fore-barrel 110 by way of the front 150 and rear 140 alignment sleeves. Locking pins 130 may take the form of screws, bolts, threaded tubes, spring pins, locating pins, permanent welds, or many other suitable securing mechanisms which are well-known in the art. In an embodiment, eight locking pins 130 can be used to secure the suppressor assembly 101 to the fore-barrel 110—four to the FAS side wall 151 and four to the RAS side wall 141. In other embodiments, more or fewer locking pins 130 can be utilized.

Locking pins 130 can be designed for ease of removal, or conversely, for difficulty of removal. In an embodiment, a set of easily removable locking pins 130 can be modified such that they are difficult to remove, e.g. by epoxying the locking pin 130 in place or drilling out the features or sawing off the head of a screw. This may be advantageous where the regulatory environment treats removable and integral suppression systems differently.

h. Flash Chamber and Backpressure Chambers

A flash chamber 170 may be formed as the space bounded in the axial direction by the FAS 150 and the rearmost baffle 120*a*, and by the inner surface of the tube 102 in the radial direction. A backpressure chamber 160 can be formed as the space bounded in the axial direction by the FAS 150 and RAS 140, and by the inner surface of the tube 102 in the radial direction.

Gases produced in the firing of ammunition can flow from the barrel bore 111 into the flash chamber 170. In an embodiment, one or more ports 130 in the FAS 150 can allow gases to flow backward into the backpressure chamber 160, and one or more ports 130 in the rearmost baffle 120*a* can allow gases to flow forward into the first vent chamber 180 (also called "outer chamber"), in addition to gas flow through the baffle bore 125 of the rearmost baffle 120*a*.

In an embodiment, the flow and distribution of gases through the backpressure 160, flash 170, vent 180, and baffle 126 chambers in the suppressor assembly 101 of a suppressor-equipped 100 weapon can help mitigate the explosive air pressure wave that accompanies the muzzle blast inherent to the firing of ammunition. In another embodiment that may be consistent with the preceding embodiment, the flow and distribution of gases through the various chambers can help mitigate excessive heating of the suppressor assembly 101.

In an embodiment, the radial bound of the flash chamber 170 can be a coupling between the FAS 150 and rearmost baffle 120*a*, rather than the inner surface of the tube 102.

i. Gas Management Assembly

A suppressor 100 may include a gas management assembly 410. A GMA 410 may comprise a gas block 411, gas tube 412, and various coupling and stabilizing mechanisms such as a set screw assembly 415. A gas tube 412 may itself comprise a gas tube port 413 from which bullet gases can enter the gas tube 412 from the vicinity of the gas block 412, and exit out a gas tube mouth 414. In various embodiments, the gas tube mouth 414 allows gasses to flow back toward the proximal end of the firearm to interface with a gas-operated system such as a reloading system (e.g. direct impingement or piston). A suppressor 100 may achieve improved operational characteristics—which may include cycling (including feed and ejection), heating, SPL reduction, blowback, ammunition versatility (i.e. tolerance to weight variations), operating time, etc. —by allowing a backpressure chamber 160 to also function as a gas reservoir for a gas management assembly 410.

Set screw assembly 415 is one possible method of mechanically securing the GMA 410, but such mechanical securing may additionally or alternatively comprise threading, pins, springs, and various other mechanical securing means. In an embodiment, components of GMA 410 (e.g. gas block 411) may be combined with or integral to rear alignment sleeve 140. A GMA 410 may comprise various of the above described components in combination (e.g. integral gas block 411 and gas tube 412), with additional components (e.g. a piston, a spring), or alternate configurations (e.g. multiple gas tubes 412, gas tube port 413 integrated with tube 102). In various embodiments, gas tube 412 may be protected by a guard structure around the tube 102 and/or fore-barrel 110, or parts thereof.

III. RETROFIT

Figure 7:
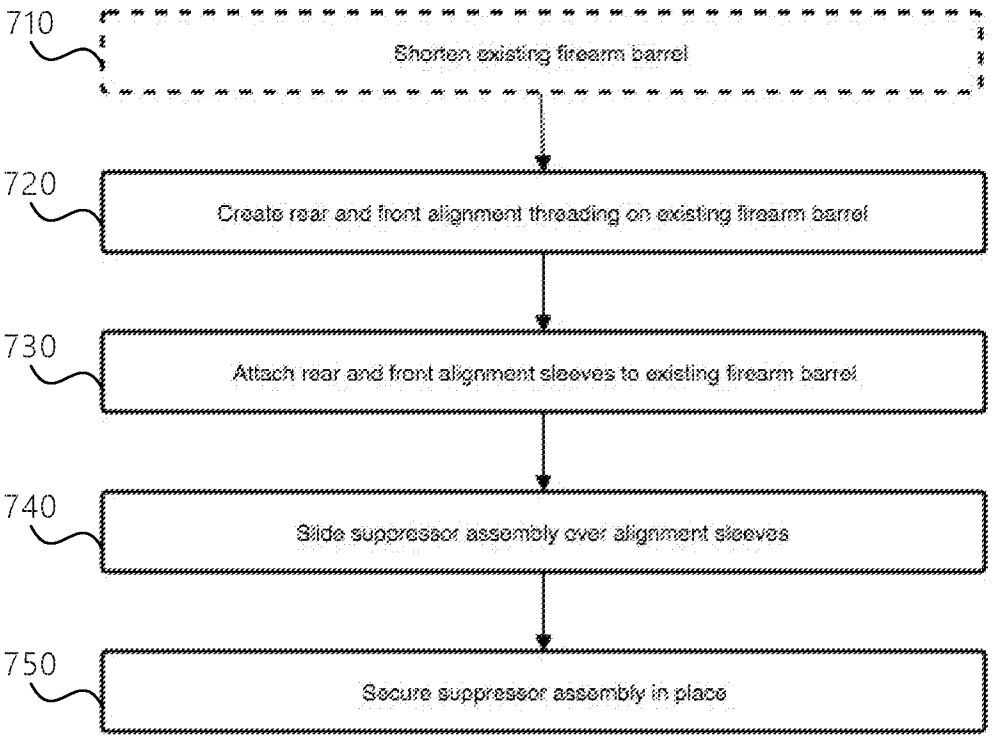
FIG. 7 illustrates a flowchart depicting a method of retrofitting an existing firearm with a ported baffle firearm suppressor in accordance with various embodiments of the present disclosure.

Referring now to FIG. 7, there is shown an exemplary method 700 for retrofitting an existing firearm with a suppressor 100 in accordance with an embodiment.

At stage 710, an existing firearm can, optionally, be shortened such that the resultant fore-barrel 110 can accommodate the added length of the suppressor assembly 101. This stage can be achieved by, for example, mechanically sawing or cutting the barrel.

At stage 720, the fore-barrel 110 of the existing firearm can have rear alignment threading 112 and front alignment threading 113 applied to its exterior surface. This stage can be used to add the coupling mechanisms that will connect rear alignment sleeve 140 and front alignment sleeve 150 to the fore-barrel 110. This stage can be achieved by, for example, machining or etching surface features (such as threads, protrusions, or depressions) into the surface of the fore-barrel 110. In an embodiment, the thread directions of the rear alignment threading 112 and front alignment threading 113 can be opposed.

At stage 730, the rear alignment sleeve 140 and front alignment sleeve 150 can be attached to the fore-barrel 110 of the existing firearm. This stage can be achieved by, for example, screwing the respective alignment sleeves into place on the threading areas of the fore-barrel 110. Alternatively or additionally, this stage can be achieved by employing another coupling mechanism such as a spring, magnetic, or bearing mechanism, or locking protrusions.

At stage 740, the suppressor assembly 101 (minus the FAS 150 and RAS 140) can slide over the fore-barrel 110 (with attached FAS 150 and RAS 140). In this stage, the FAS 150 and RAS 140 can provide multipoint stabilization that properly aligns the baffle bores 125 and exit hole 192 with the barrel bore 111, such that fired ammunition has a clear exit path. This stage can be achieved by, for example, sliding the suppressor assembly 101 in the axial direction, toward and over the distal end of the fore-barrel 110.

At stage 750, the suppressor assembly 101 can be secured in place with one or more locking pins 103. In this stage, a final, structurally integrated suppressor-equipped 100 firearm can be achieved. This stage can be accomplished by, for example, screwing in a series of threaded screws, inserting spring pins, or other locking mechanisms. In one embodiment, a total of eight locking pins 103 can be employed, four each into the FAS 151 and RAS 141 sidewalls. As part of this step, a removable locking pin 103 can optionally be modified to make it more difficult to remove, as by epoxying the locking pin 130 assembly or drilling out the features or sawing off the head of a screw.

The order of stages presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the invention being indicated by the following claims.

IV. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A suppressor for a firearm, the suppressor comprising:
a tube having an inner wall;
one or more alignment sleeves that that attach to a firearm barrel;
a backpressure chamber;
an array of baffles inside the inner wall, each baffle comprising:
a baffle bore extending axially through the baffle;
a distal cavity at a distal end of the baffle;
an outer surface that radially recesses toward the baffle bore to form an outer cavity between the outer surface of the baffle and the inner wall of the tube; and
an entry face at a proximal end of the baffle, the entry face comprising one or more baffle ports,
wherein successive baffles comprising the baffle ports are configured to distribute gases produced in firing ammunition into the baffle bore and the backpressure chamber,
wherein the entry face of each of the baffles comprises an equivalent or smaller number of baffle ports than the entry face of the baffle located proximal to the baffle, and
wherein the frontmost baffle comprises a smaller number of baffle ports than the rearmost baffle; and
a muzzle plate.

2. The suppressor of claim 1, further comprising a gas management assembly.

3. The suppressor of claim 2, wherein the gas management assembly has a gas tube port located in the backpressure chamber.

4. The suppressor of claim 1, wherein the array of baffles comprises a first baffle and a second baffle distal to the first baffle, further wherein the distal cavity of the first baffle comprises a coupling surface configured to detachably couple with the entry face of the second baffle.

5. The suppressor of claim 1, further comprising a flash chamber and at least three outer cavities, wherein the backpressure chamber, the flash chamber, and the at least three outer cavities are connected by at least a plurality of ports.

6. A firearm suppressor system for a firearm comprising:
a fore-barrel;
a suppressor assembly;
an axial direction along the direction of fire of ammunition from the firearm, wherein the point of exit of ammunition from a far end of the firearm forms the most anterior point of the axial direction, with points further away from the far end of the firearm successively more posterior; and
a radial direction perpendicular to the axial direction,
wherein the fore-barrel comprises a barrel bore aligned in the axial direction, further wherein the suppressor assembly comprises:

a tube aligned in the axial direction with the fore-barrel, wherein a posterior end of the tube is coupled with an anterior end of the fore-barrel;

a muzzle plate having an exit hole and a posterior face, wherein the posterior face is coupled to an anterior end of the tube;

a plurality of baffles arranged inside the tube along the axial direction, each baffle comprising:

a posterior face;

a baffle bore; and one or more ports, and at least two chambers connected, such that bullet gas can travel between them, by one or more ports of each of the plurality of baffles, wherein the at least two chambers are configured to distribute gasses evenly throughout the suppressor assembly according to the plurality of baffles arranged inside the tube;

wherein each of the plurality of baffles comprise an equivalent or smaller number of ports than the baffle anterior to the baffle; and wherein the frontmost baffle comprises a smaller number of baffle ports than the rearmost baffle.

7. The firearm suppressor system of claim 6, further comprising a gas management assembly.

8. The firearm suppressor system of claim 7, wherein the gas management assembly is integrated with the coupling between the posterior end of the tube and the anterior end of the fore-barrel.

9. The firearm suppressor system of claim 6, wherein the coupling between the posterior end of the tube and the anterior end of the fore-barrel comprises at least one alignment sleeve.

10. The firearm suppressor system of claim 9, wherein the at least one alignment sleeve comprises a front alignment sleeve and a rear alignment sleeve, further wherein the front alignment sleeve comprises one or more ports.

11. The firearm suppressor system of claim 6, wherein the tube is constructed from carbon fiber.

12. The firearm suppressor system of claim 11, wherein the muzzle plate is coupled to the tube via an adhesive.

13. The firearm suppressor system of claim 6, wherein at least one of the one or more baffles is constructed from a material comprising at least one of stainless steel and aluminum.

14. The firearm suppressor system of claim 6, wherein the one or more baffles comprises at least a first baffle and a second baffle anterior to the first baffle, further wherein the one or more ports of the first baffle exceed the one or more ports of the second baffle in at least one of total cross-sectional area and total number of ports.

15. The firearm suppressor system of claim 6, wherein the suppressor assembly is detachable from the firearm.

16. The firearm suppressor system of claim 6, wherein each of the one or more baffles is coupled with at least one and at most two other baffles.

17. The firearm suppressor system of claim 16, wherein the coupling between baffles comprises interfacing the anterior lip of a first baffle with the posterior face of a second baffle.

18. The firearm suppressor system of claim 17, wherein the first baffle comprises a conical cavity opening to the anterior lip, further wherein the coupling of the first baffle and the second baffle creates a baffle chamber having openings to the one or more ports in the posterior face of the second baffle and to the baffle bores of each of the first baffle and the second baffle.

19. A method of retrofitting a suppressor to an existing firearm, the method comprising:

creating rear alignment threading and front alignment threading on a fore-barrel of the existing firearm;

attaching a rear alignment sleeve comprising rear alignment sleeve threading to the fore-barrel by coupling the rear alignment sleeve threading with the rear alignment threading;

attaching a front alignment sleeve comprising front alignment sleeve threading to the fore-barrel by coupling the front alignment sleeve threading with the front alignment threading;

assembling a suppressor assembly comprising an array of baffles each having at least one baffle port and configured to evenly distribute gas backpressure across the suppressor assembly, wherein assembling the suppressor assembly comprises configuring the number of baffles in the baffle array and the number of baffle ports on each baffle in the baffle array, and wherein assembling the suppressor assembly comprises arranging the baffles such that the frontmost baffle comprises a smaller number of baffle ports than the rearmost baffle;

sliding the suppressor assembly over the alignment sleeves; and securing the suppressor assembly to the alignment sleeves with locking pins.

20. The method of claim 19, further comprising an initial step of shortening the length of the existing firearm's barrel.

* * * * *